US005107866A

United States Patent [19]

Aronoff et al.

[11] Patent Number: 5,107,866

[45] Date of Patent: Apr. 28, 1992

[54] HEATSEAL POROUS PLUGWRAP USING HOT MELT ADHESIVE

[75] Inventors: Arthur Aronoff, Roswell; Larry D. Snow, Alpharetta; Vladimir Hampl, Jr., Roswell; R. Dwayne Hotaling, Alpharetta, all of Ga.

[73] Assignee: Kimberly-Clark Corporation, Neenah, Wis.

[21] Appl. No.: 590,407

[22] Filed: Sep. 28, 1990

[51] Int. Cl.[5] ..... A24D 1/02

[52] U.S. Cl. ..... 131/365; 131/336

[58] Field of Search ..... 131/365, 336

[56] References Cited

U.S. PATENT DOCUMENTS 4,020,850 5/1977 Cogbill, II .
4,295,478 10/1981 Yeatts .
4,326,543 4/1982 Martin et al. .
4,366,826 1/1983 Horsewell ..... 131/336
4,411,279 10/1983 Martin et al. .
4,480,644 11/1984 Luke .
4,607,647 8/1986 Dashley et al. ..... 131/365
4,784,164 11/1988 Adams et al. .

FOREIGN PATENT DOCUMENTS 3005793 8/1981 Fed. Rep. of Germany .
1575910 10/1980 United Kingdom .
2099678B 9/1984 United Kingdom .

*Primary Examiner*—V. Millin
*Assistant Examiner*—Lynne A. Reichard
*Attorney, Agent, or Firm*—William D. Herrick

[57] ABSTRACT

A heatseal porous plugwrap made with a naturally porous combiner wrap and spray-applied hot melt adhesive. The natural porosity of the combiner wrap paper and the superficial location of sprayed adhesive greatly inhibit the penetration of adhesive to the outer surface of the paper, thus minimizing the possibility that the adhesive will interfere with the tipping process. The use of a sprayer to apply the adhesive allows for only the required amount of adhesive to be utilized and thus eliminates waste.

15 Claims, 1 Drawing Sheet

HEATSEAL POROUS PLUGWRAP USING HOT MELT ADHESIVE

TECHNICAL FIELD

The present invention relates generally to filters for smoking articles, and particularly relates to charcoal-loaded filters which are held together by sheets of porous paper of sufficient stiffness to prevent collapse of the filter. Limited quantities of hot melt adhesive are sprayed, in random patterns, onto an inner surface of the paper, to which the charcoal filter assembly is anchored. The location and level of adhesive sprayed upon the first surface minimizes the penetration of adhesive through the thickness of the paper to an outer surface, reducing the amount of adhesive needed and decreasing the likelihood that the hot melt adhesive will interfere with the tipping process.

BACKGROUND OF THE INVENTION

In the tobacco industry, various types of filter devices have been developed which permit the blending of air and cigarette smoke within the filter itself. A common type of filter device consists of two plugs of fibrous material surrounding a cavity in which charcoal is situated. The filter plug-charcoal cavity-filter plug assembly (the "plug assembly") is assembled as follows. A sheet of machine-perforated paper, known as a combiner wrap, is machine-rolled with a quantity of heated hot melt adhesive. While the adhesive is still hot (and therefore fluid), the filter plugs are anchored to the combiner wrap and a quantity of charcoal is placed in the cavity between the two filter plugs. The combiner wrap is of a sufficient stiffness to prevent collapse of the charcoal cavity.

The perforations of the combiner wrap are holes which are basically straight-line cavities extending the entire thickness of the paper. When the hot melt adhesive is rolled onto the inner surface of the perforated combiner wrap, the adhesive tends to penetrate through the perforations and onto the outer surface of the combiner wrap. This limits ventilation level and causes a problem when the tipping process is initiated. The plug assembly is attached to the cigarette rod (a tobacco column wrapped with paper) by a tipping paper. The tipping paper is adhered to both the cigarette paper and the plug assembly by an aqueous adhesive. If the hot melt adhesive has soaked through the combiner wrap to the outer surface, which is adjacent to the tipping paper, the tipping paper's adhesive will not bond as effectively to the combiner wrap. This interference creates a ventilation problem within the cigarette. The tipping process is well known in the art, as illustrated in U.S. Pat. Nos. 4,295,478; 4,411,279; and 4,480,644, all of which are incorporated herein by reference.

In addition, the rolling of hot melt adhesive onto perforated paper results in the use of more adhesive than is actually necessary to properly seal the plug assembly, as adhesive not at the paper's surface is unavailable for sealing. In other industries, such as the disposable diaper industry, adhesive is sprayed onto surfaces. However, unlike the tobacco industry, the disposable diaper industry is not concerned with air ventilation.

It is well known in the industry to use naturally porous paper for the combiner wrap instead of artificially perforated paper, as illustrated in United Kingdom Patent No. 2099678B, also incorporated herein by reference. An advantage of naturally porous paper is that the pores are not straight-line holes extending the entire thickness of the paper. Instead, the pore form randomly shaped, circuitous paths stretching from one surface of the paper to the other. However, the method of rolling hot melt adhesive onto porous, as opposed to perforated, combiner wrap paper, still results in the penetration of adhesive into the combiner wrap paper, leaving the above-mentioned problems of ventilation and wasted adhesive unsolved..

Accordingly, there is a need in the art for an improved method of applying adhesive to combiner wrap paper such that the adhesive does not penetrate into the paper and interfere with the tipping process.

There is also a need in the art to provide an improved cigarette filter which uses only the requisite quantity of hot melt adhesive.

SUMMARY OF THE INVENTION

The present invention overcomes the aforementioned problems by providing a heatseal porous plugwarp which includes a naturally porous combiner wrap, to which hot melt adhesive is randomly sprayed in limited quantities.

Generally described, the preferred embodiment of the present invention provides a plug assembly which is bonded together by a naturally porous combiner wrap. During manufacture, the adhesive is applied to the combiner wrap by means of a spray nozzle.

More particularly described, the preferred embodiment of the present invention is assembled as follows. First, a quantity of naturally porous paper is manufactured. The paper is typically composed of twenty percent chemically modified high alpha pulp and eighty percent softwood, with 50–100 milligrams of total stiffness. The paper is stiff enough to avoid collapse over the charcoal cavity area. The paper is coated with 2–4 percent polyvinyl alcohol or 5–10 percent starch to keep the hot melt adhesive from flowing into, or through, the combiner wrap paper either during the application of hot melt adhesive onto the sheet or during the actual plugmaking operation.

The combiner wrap paper has a natural porosity of between 2,000 and 10,000 centimeters per minute (cm/min). The natural porosity of the paper means that the porosity is not attained with void areas passing straight through the thickness of the paper, such as those present in manually perforated papers. Rather, the voids (or pores) in the naturally porous paper are capillary in nature, such that the route traveled from one end of the pore to the other is winding and circuitous. The combiner wrap paper is approximately 50 mils thick.

The combiner wrap paper is manufactured on a conventional inclined wire paper machine, and the paper is not wet pressed. The chemical or starch coating is added to the paper at the size press.

After the combiner wrap paper is manufactured, a quantity of hot melt adhesive is applied to the paper. A suitable adhesive has the following characteristics: light color or colorless, normal odor, thermally reactivates, does not block (i.e., adhere within the rolled plug assembly) at ambient or reasonably high temperatures, does not blend through the thickness of the paper upon reactivation, and processes at temperatures of conventional hot melt equipment. The adhesive used in the preferred embodiment of the present invention is composed of an ethylene vinyl acetate copolymer containing 10–40 percent vinyl acetate; a wax, either paraffin, microcrystalline, or synthetic, with a melting point of 130–220 degrees Fahrenheit; and a tackifying resin, such as hydrocarbon or aromatic hydrocarbon, with a melting point of 50–140 degrees Celsius.

The hot melt adhesive is applied to the combiner wrap paper via spray nozzles at a distance of one to four inches above the paper. The adhesive is heated to a temperature of 300–400 degrees Fahrenheit prior to application. The adhesive is sprayed in either a spiral or random design. The adhesive is applied such that there are 3–20 grams of adhesive for each square meter of combiner wrap paper (gsm).

The filter rod is fully assembled by bonding the filter components to the combiner wrap paper. The combiner wrap containing the hot melt adhesive is heated to a temperature of 400–600 degrees Fahrenheit, at which temperature two fibrous filter plugs of a type which is well known in the tobacco industry, are anchored to the combiner wrap paper. The filter plugs are positioned such that they lie on the same line with a space of approximately 0.5–1.5 cm between them. Next, charcoal is placed within the space between the two filter plugs. While the hot melt adhesive is still heated, the combiner wrap paper is wrapped around the plug assembly and seamed at 500–650 degrees Fahrenheit, sealing the plug assembly within the combiner wrap paper.

Therefore, it is an object of this invention to provide a heatseal porous plugwrap to which hot melt adhesive is sprayed such that the adhesive will not penetrate the thickness of the naturally porous combiner wrap paper.

It is a further object of this invention to provide a heatseal porous plugwrap which requires smaller amounts of hot melt adhesive than prior plugwraps.

Other objects, features, and advantages of the present invention will become apparent upon reading the following specification when taken in conjunction with the accompanying drawings.

DETAILED DESCRIPTION OF THE PREFERRED EMBODIMENT

Figure 1:
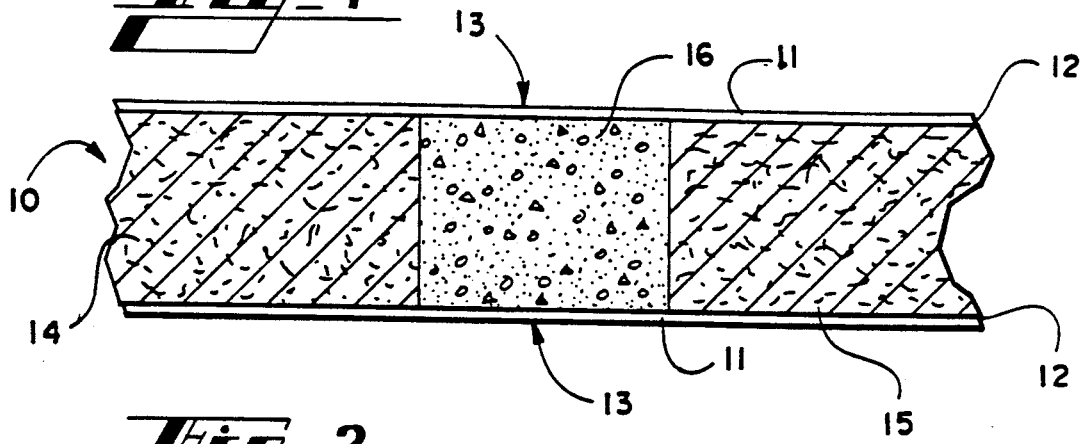
FIG. 1 is a cross-sectional view of the preferred embodiment of the present invention, fully assembled.

Turning now to the drawings, in which like numerals represent like parts throughout the several views, FIG. 1 is a cross sectional perspective of the preferred embodiment of the present invention, fully assembled. The heatseal porous plugwrap 10 consists primarily of a quantity of naturally porous combiner wrap paper 11, two fibrous filter plugs 14, 15, and a quantity of charcoal 16. The combiner wrap paper 11 includes an inner surface 12 and an outer surface 13.

Figure 2:
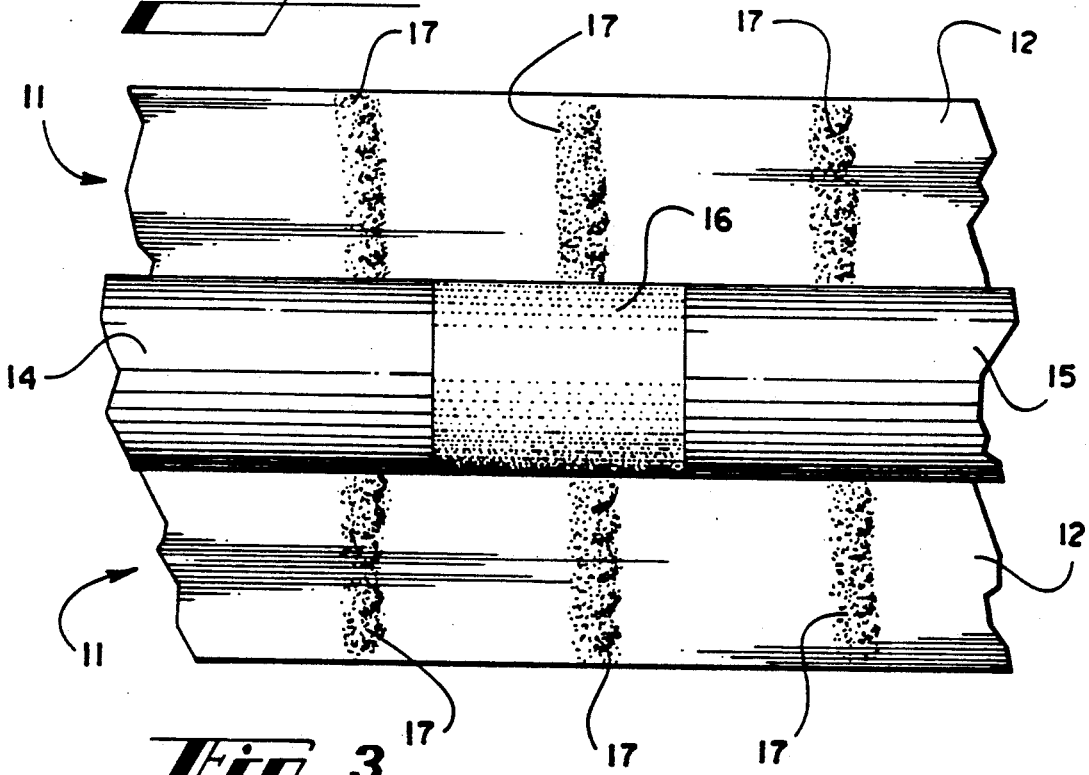
FIG. 2 is a top view of the preferred embodiment of the present invention, prior to sealing the plug assembly within the combiner wrap paper.

Turning to FIG. 2, it may be seen that the hot melt adhesive 17 is sprayed on the inner surface 12 of the combiner wrap paper 11. The adhesive 17 is sprayed onto the inner surface 12 of the paper 11 after the adhesive 17 has been heated up to a liquid state. While the adhesive 17 is thermally reactivated, the combiner wrap paper 11 id wrapped around the filter plugs 14, 15 and the charcoal 16 such that the filter plugs 14, 15 and the charcoal 16 are bonded to the inner surface 12 of the paper 11.

Figure 3:
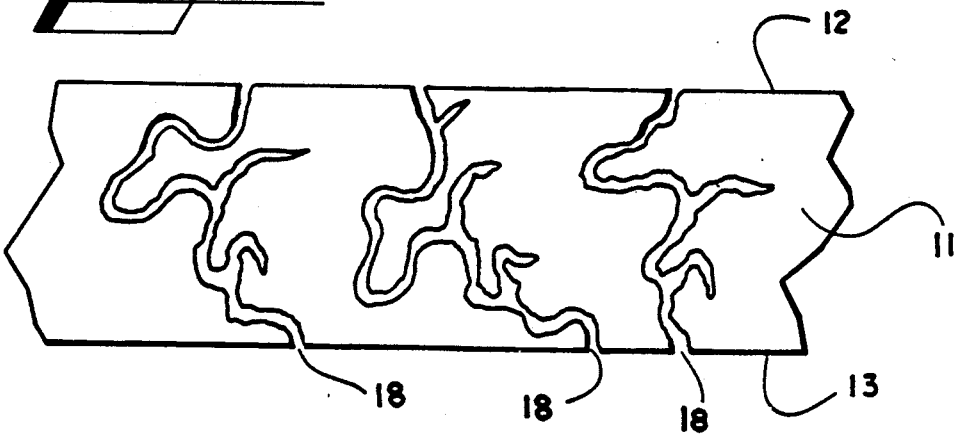
FIG. 3 is a cross-sectional view of the thickness of the combiner wrap paper.

FIG. 3 illustrates the thickness of the combiner wrap paper 11. Due to the natural porosity of the paper 11, the pores 18 in the paper, which would be straight if the pores were man-made by perforation, consist of roundabout, circuitous routes from the inner surface 12 to the outer surface 13 of the paper. The configuration of these holes 18 greatly inhibits the capacity of the hot melt adhesive 17, when applied to the inner surface 12 of the paper 11, to penetrate the entire thickness of the paper 11 and interfere with the tipping process, discussed in detail hereinabove.

While this invention has been described in detail with reference to the preferred embodiment thereof, it will be understood that variations and modifications can be made within the spirit and scope of the invention as described here and above and defined below in the appended claims.

What is claimed is:

1. An improved cigarette filter, comprising:

a first filter plug;

a second filter plug;

a filter cavity located between said first and second filter plugs;

a naturally porous combiner wrap having an inner surface for contacting said first filter plug and said second filter plug and an opposing outer surface; and 3–20 gsm of hot melt adhesive on said inner surface of said combiner wrap and not penetrating the thickness of said combiner wrap.

2. The cigarette filter of claim 1, whereby said first an second filter plugs are made from fibrous material.

3. The cigarette filter of claim 1, whereby said filter cavity consists of a quantity of charcoal.

4. The cigarette filter of claim 1, wherein said combiner wrap is composed of about twenty percent chemically modified high alpha pulp and about eighty percent softwood.

5. The cigarette filter of claim 4, whereby said combiner wrap has about 50–100 milligrams of total stiffness.

6. The cigarette filter of claim 5, whereby said combiner wrap has a natural porosity of about 2000–10,000 centimeters per minute.

7. The cigarette filter of claim 6, whereby said combiner wrap is about 50 mils thick.

8. The cigarette filter of claim 7, whereby said combiner wrap is coated.

9. The cigarette filter of claim 8, whereby said coating comprises 2–4 percent polyvinyl alcohol.

10. The cigarette filter of claim 8, whereby said coating comprises 5–10 percent starch.

11. The cigarette filter of claim 8, whereby said combiner wrap is manufactured on a conventional inclined wire paper machine.

12. The cigarette filter of claim 11, whereby said combiner wrap is not wet pressed.

13. The cigarette filter of claim 1, whereby said hot melt adhesive is comprised as follows:

ethylene vinyl acetate copolymer containing ten to forty percent vinyl acetate;

wax with a melting point of 130–220 degrees Fahrenheit; and a tackifying resin with a melting point of 50–140 degrees Fahrenheit.

14. The cigarette filter of claim 13, whereby said filter is either paraffin, microcrystalline, or synthetic.

15. The cigarette filter of claim 13, whereby said tackifying resin is either a hydrocarbon or an aromatic hydrocarbon.

* * * * *